US005213556A

United States Patent [19]

Boren

[11] Patent Number: 5,213,556

[45] Date of Patent: May 25, 1993

[54] MOTION CONVERTING MECHANISM FOR AN EXERCISE MACHINE

[76] Inventor: John P. Boren, 9940 Old Katy Rd., Houston, Tex. 77055

[21] Appl. No.: 912,095

[22] Filed: Jul. 10, 1992

Related U.S. Application Data

[63] Continuation of Ser. No. 705,787, May 28, 1991, abandoned.

[51] Int. Cl.[5] ..... A63B 21/062

[52] U.S. Cl. ..... 482/137; 482/100

[58] Field of Search ..... 482/1-9, 482/94, 97-103, 104, 106, 112-113, 133-138

[56] References Cited

U.S. PATENT DOCUMENTS

| | | | |
|---|---|---|---|
| 3,807,728 | 4/1974 | Chillier | 272/118 |
| 3,856,297 | 12/1974 | Schnell | 272/117 X |
| 3,982,757 | 9/1976 | McDonnell | 272/134 |
| 4,316,609 | 2/1982 | Silberman | 272/123 X |
| 4,462,252 | 7/1984 | Smidt et al. . | |
| 4,628,910 | 12/1986 | Krukowski | 272/129 |
| 4,657,246 | 4/1987 | Salyer | 272/117 |
| 4,721,301 | 1/1988 | Drake | 272/118 |
| 4,763,897 | 8/1988 | Yakata | 272/118 |
| 4,834,365 | 5/1989 | Jones . | |
| 4,834,396 | 5/1989 | Schnell | 272/117 |
| 4,842,271 | 6/1989 | Vinciguerra | 272/134 X |
| 4,859,919 | 8/1989 | Jones . | |
| 4,902,008 | 2/1990 | Jones . | |
| 4,902,009 | 2/1990 | Jones . | |
| 4,930,768 | 6/1990 | Lapcevic | 272/117 |

FOREIGN PATENT DOCUMENTS

| | | | |
|---|---|---|---|
| 3445104 | 6/1986 | Fed. Rep. of Germany | 272/134 |

OTHER PUBLICATIONS

Rehab Management, Michael Fulton, MD, Nov./Dec. 1988.

*Primary Examiner*—Robert Bahr

*Attorney, Agent, or Firm*—Bush, Moseley & Riddle

[57] ABSTRACT

In accordance with an illustrative embodiment of the present invention, a motion converting mechanism for an exercise machine includes a shaft mounted on spaced bearings on opposite walls of a side compartment of the machine, a pitman arm on the shaft, a drive assembly including inner and outer arms extending above and below the shaft, a linkage and transducer that connect the outer end of the pitman arm to the lower end of the drive assembly, a lifting wheel on the shaft between the inner and outer drive arms, and a laterally shiftable pin that extends through the outer drive arm, one of a plurality of holes near the outer periphery of the lifting wheel and into the inner arm to connect the drive assembly to the lifting wheel in any one of a plurality of relative orientations. A stop against pivotal rotation of the lifting wheel also is provided to enable static tests to be made of certain ones of the users muscles.

15 Claims, 2 Drawing Sheets

MOTION CONVERTING MECHANISM FOR AN EXERCISE MACHINE

This application is a continuation of application Ser. No. 07/705,787 filed May 28, 1991 now abandond.

FIELD OF THE INVENTION

This invention relates generally to exercise machine motion connecting or translating mechanisms, and particularly to a new and improved mechanism for converting pivotal rotation of a frame member of an exercise machine to vertical movement of a restraining weight system while providing output signals to a computer which calculates and displays certain information about muscle strength and the like.

BACKGROUND OF THE INVENTION

An exercise machine having a motion converting mechanism that is relevant to the present invention is illustrated in U.S. Pat. No. 4,902,009 issued in the name of Arthur Jones on Feb. 20, 1990. According to this patent, a link is connected to the lower end of one side of an inclined pivot arm and to an ear on the lower portion of an upstanding arm assembly. The arm assembly carries a pair of toggle operated locking pins which can be selectively engaged in angularly arranged upper and lower series of holes in a sprocket wheel. The sprocket wheel is connected to a chain that extends up over a sheave near the top of the machine, and then down to a counterweight assembly. The pins are jointly operated by a toggle arm having its center pivoted to the outer end of a transverse shaft that supports and is rotated by, the side member of a movement frame that is forced backward by the user. The sprocket wheel and the upstanding arm assembly are mounted on this shaft for rotation relative thereto, and the pins cause the sprocket to rotate in response to pivotal movement of the inclined arm and the upstanding arm assembly. A gauge is located in the link so as to provide output signals representative of strain to a computer that is programmed to compute static strength of the user of the machine at the various angles to which the upstanding arm assembly is connected to the sprocket wheel by the toggle arm and pins.

This motion converting mechanism is believed to be entirely too complex, and therefore expensive to manufacture and to maintain. The toggle arm is on the outside of the machine, and pivots with the movement arms as the user pivots the arm backward and forward during each exercise cycle. The toggle arm thus provides a safety hazard to anyone standing near the machine, particularly if the counterweight chain should become severed when the user has tilted the frame member to its rearmost position. This safety hazard is further highlighted by the fact that the toggle arm has an outwardly inclined handle bar at its upper end which could cause very severe injury to someone as the massive counterweight accelerates downward.

The general object of the present invention is to provide a new and improved motion converting mechanism for an exercise machine that is simplified and thus more economical to make and maintain.

Another object of the present invention is to provide a new and improved motion converting mechanism of the type described that is safe and reliable in operation.

Still another object of the present invention is to provide a motion converting mechanism of the type described that includes new and improved means to allow static and dynamic strength measurements to be made during exercise.

SUMMARY OF THE INVENTION

These and other objects are attained in accordance with the concepts of the present invention through the provision of a motion converting mechanism for an exercise machine comprising a pitman arm driven by the pivotal frame member of the machine, another arm connected by linkage means to the outer end of the pitman arm so as to be pivoted thereby, and a lifting wheel adapted to be connected to the other arm in a plurality of angular orientations with respect thereto. Rotation of the lifting wheel in one direction causes a counterbalance weight system to be raised, and vice versa. The weight system thus restrains pivotal movement of the frame member in said one direction, and tends to cause pivotal rotation thereof in the opposite direction.

A pin is used to connect the upper end of the other arm to any one of a plurality of holes arranged in a sector near the upper outer periphery of the lifting wheel. A tension force transducer is connected in the linkage means so as to continuously provide output signals that are indicative of the magnitude of the tension forces on the linkage, which can be related to strength and to work done by the user in pivoting the frame member rearward, and in allowing the frame member to pivot forward during each exercise cycle. The orientation at which the lifting wheel is connected to the other arm by the pin enables the starting angle of the frame member with respect to vertical, or to some other reference, to be selectively set.

A stop arm that is fixed to the lifting wheel is arranged to be selectively engaged by a plunger which prevents rotation of the lifting wheel while the static strength of the user's back muscles is measured at various inclinations of the back pad and frame with respect to the pelvic region. The plunger is released from engagement with the stop arm during exercise cycles of rearward and forward movement. The output signals of the transducer are fed to a computer which provides a display on a monitor of various types of information that are useful in safely exercising or testing certain muscles in order to tone or rehabilitate them, or in diagnosing injury to such muscles. There are no swinging toggle arms or handles on the outside of the machine that present a safety hazard to anyone around the machine. The mechanism is greatly simplified with respect to prior structures, and thus is considerably less expensive to manufacture and to maintain.

BRIEF DESCRIPTION OF THE DRAWINGS

The present invention has other objects, features and advantages which will become more clearly apparent in connection with the following detailed description of a preferred embodiment taken in conjunction with the appended drawings in which.

DETAILED DESCRIPTION OF A PREFERRED EMBODIMENT

Figure 1:
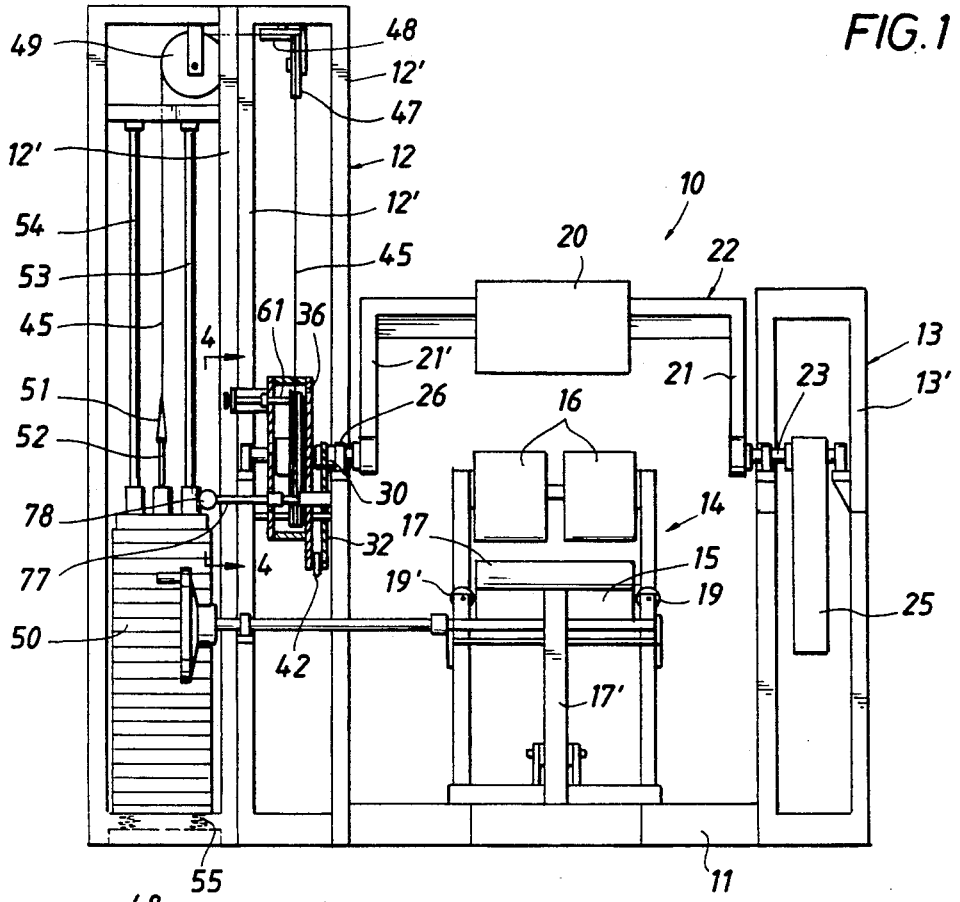
FIG. 1 is a front elevational view of an exercise machine that incorporates the present invention with some of its external panels removed to show internal mechanisms.
Figure 2:
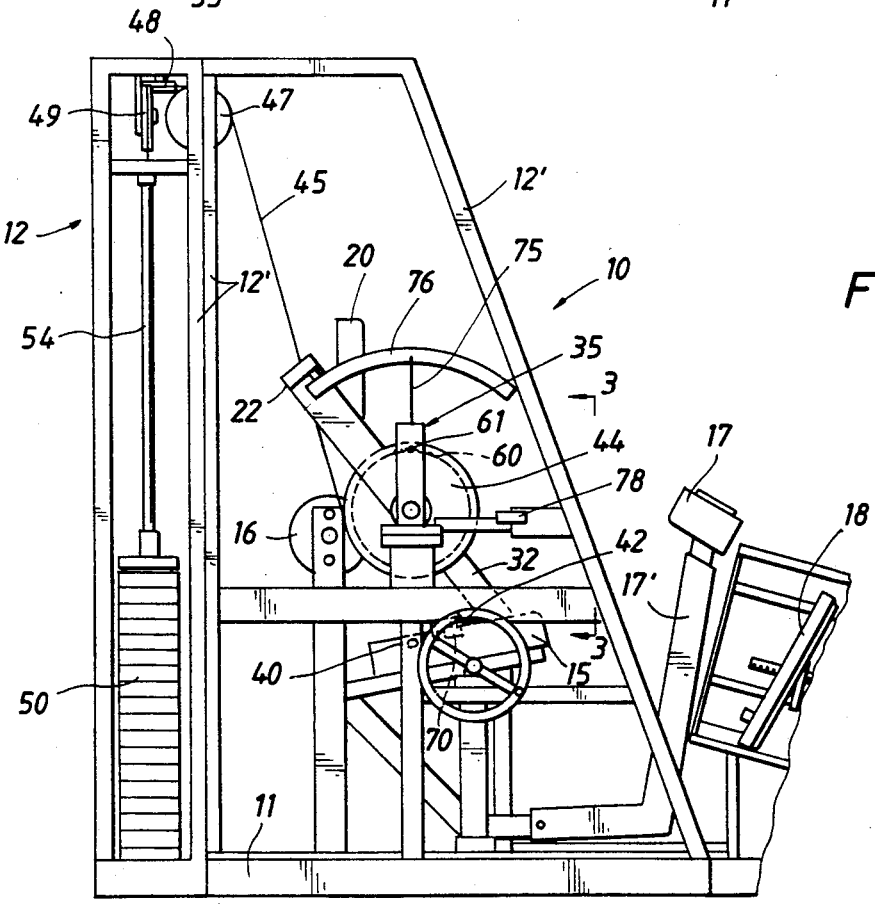
FIG. 2 is a side view of the machine similar to FIG. 1 to show additional detail of the motion converting mechanisms of the present invention.

Referring initially to FIG. 1, as exercise machine 10 of the type in which the present invention can be incorporated includes a floor-engaging base 11 having upstanding, enclosed compartments 12 and 13 to either side. The compartments 12 and 13 are framed by suitable vertical, horizontal, and other structural frame members having panels on the outer sides thereof. The base 11 supports a seat assembly including a pad 15 and a pair of horizontally arranged bolsters 16 which support the pelvic region of the user. A transverse knee restraining member 17 at the upper end of a pivotal leg 17', an adjustable foot support device 18, (FIG. 2) and laterally movable thigh restraining elements 19 and 19' are provided to essentially immobilize the lower part of the body below the lumbar muscles of the back. The upper part of the back of the user engages a generally rectangular support pad 20 that is mounted in the center upper part of an inverted, U-shaped frame member 22 that is mounted on stub shafts 23,24 which extend outward in opposite directions from the lower ends of the side members 21 and 21' of the frame 22. The right side shaft 23, as viewed from the front, is coupled to a static counterweight 25 that is housed in the compartment 13 in order to balance the cumulative weights of the frame member 22 and the back pad 20 about the horizontal axis defined by the centerlines of the shafts 23,24. The shaft 24 on the left side is coupled to a motion converting mechanism that is constructed in accordance with the present invention, and which converts the torque forces applied by the user to the back pad 20 and to the frame member 22 to linear vertical movement of a counterweight assembly 50 that is housed in the compartment 12. The counterweight assembly 50 resists pivotal rotation of the pad 20 and the frame member 22 by the user, and causes the user to do work in moving these members backward, and in allowing them to move forward.

Figure 3:
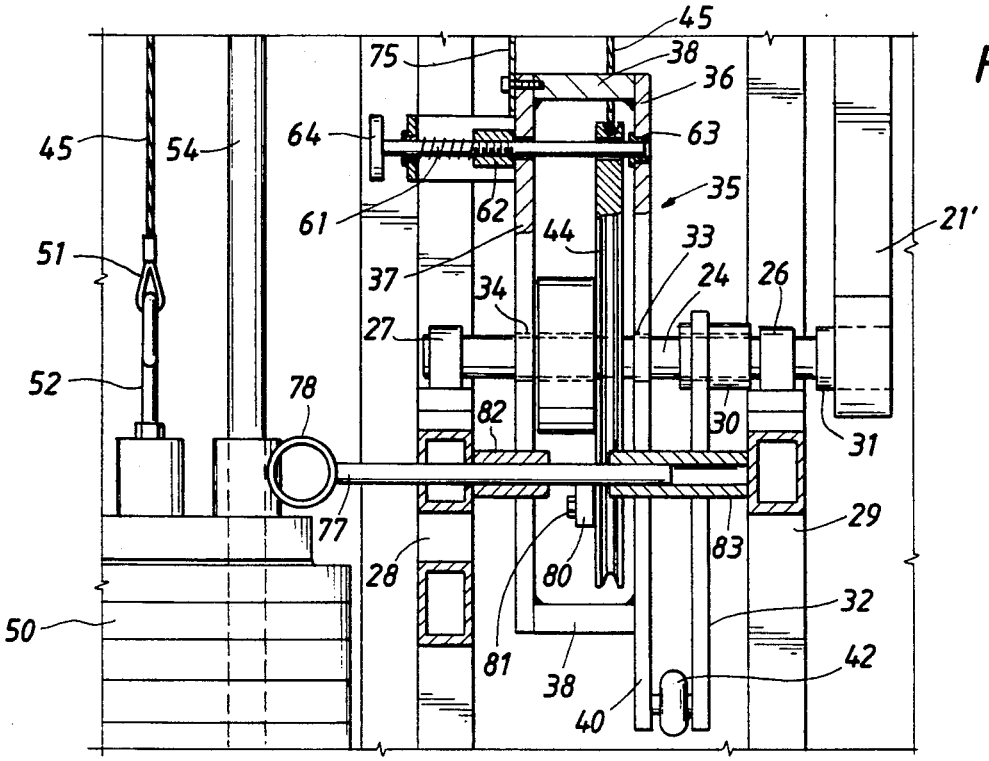
FIG. 3 is an enlarged, fragmentary view taken generally along line 3—3 of FIG. 2 and showing some parts in section and others in elevation.

As shown in further detail in FIG. 3, the left shaft 24 is mounted in spaced-apart journal bearings 26, 27 on upright structural members 28, 29 of the machine frame. A hub 31 on the inner end of the shaft 24 extends into a bore in the lower end portion of the side member 21', and is connected therein by splines or a set screw, or the like. A collar 30 that is fixed to the shaft 24 by similar means has a downward and forwardly extending pitman arm 32 mounted thereon, so that this arm rotates with the collar 30 and the shaft 24. The shaft 24 extends loosely through holes 33, 34 in a drive arm assembly 35 that includes an inner member 36 and an outer member 37 that are connected at their respective upper and lower ends by elements 38. The lower portion 40 of the inner member 36 extends below the lower element 38, and is connected to the outer end of the pitman arm 32 by a linkage 42.

A lifting wheel 44, that can be either a pulley or a sprocket, also is loosely mounted on the shaft 24 between the arm members 36, 37. The wheel 44 can have an enlarged hub on its outer side, as shown, to stabilize its rotation. A cable or chain 45 is connected to the outer periphery of the wheel 44, and is provided at least partially therearound to a point where its end is connected by suitable means. The cable 45 extends upward and then around a set of idler pulleys 47–49 (FIGS. 1 and 2), and then down to the upper end of the massive counterweight assembly 50 where it is attached thereto by an eye 51 and a hook 52. The counterweight assembly 50 can be guided on vertical rails 53,54 to prevent swinging during vertical movement. Springs 55 can be provided as a cushion at the lower limit of the counterweight movement.

Figure 4:
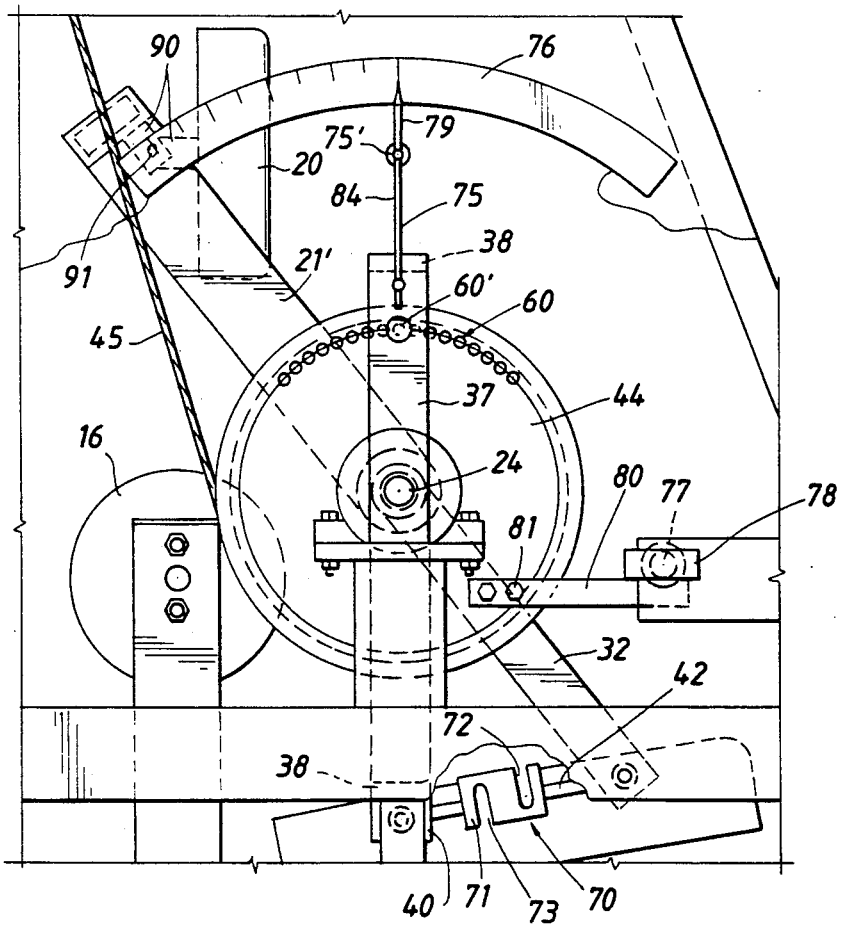
FIG. 4 is a view similar to FIG. 3 but showing the mechanisms of FIG. 3 from the side.

As shown more clearly in FIG. 4, a series of angularly distributed holes 60 are formed in the lifting wheel 44 over an upper sector thereof adjacent its outer periphery. A selected one of the holes 60 is engaged by a lock pin 61 as shown in FIG. 3, the pin extending through aligned bushings 62,63 in the inner and outer framing members 36,37, respectively. The pin 61 has a knob 64 by which it can be pulled outward, and then repositioned in another one in the holes 60 in the lifting wheel 44 in order to change the initial angle of orientation of the frame member 22 and the back pad 20 (FIG. 1) with respect to the pelvic support seat 15. This causes the user to be compelled to start exerting backward pressure on the back pad 20 in order to cause pivotal rotation of the frame member 22 at a more bent-forward position when one of the holes 60 to the left of the center hole 60' in the wheel 44 is engaged by the pin 61, and at a more backward-bent position when one of the holes to the right of the center hole is pinned. If desired, the pin 61 can be biased inward by a suitable coil spring.

The linkage 42 is shown in FIG. 4 as including a tension force transducer 70 that, for example, can include a block 71 having oppositely opening transverse slots 72,73. Strain gauges (not shown) are positioned on the curved bottom surfaces of the slots 72,73 adjacent the thin sections formed in the block 71 thereby, and the gauges can form two arms of a resistance bridge network which enables tension forces in the linkage 42 to be accurately measured. This particular location of the strain gauges provides for amplification of the strain that otherwise would be produced in the block 71 if the gauges were merely mounted on its sides. The output of the bridge is fed by suitable conductors to an appropriate A/D converter that is associated with the computer mentioned above, so that instantaneous values of the torque that the user is applying to the back pad 20 and the frame member 22 at any point is an exercise cycle are available for data processing in the computer.

A pointer 75 that is fixed in a suitable manner to the upper end portion of the outer drive member 37 has an upper portion that is arranged to register on an arcuate scale 76 on the outer wall of the compartment 12 to provide a usual indication of the starting angle of the frame member and back pad 22,20 with respect to the pelvic support seat 15. The pointer is provided with a transverse portion 75' that positions the upper portion 79 outside the panel of the compartment 12 while the lower portion 84 of the pointer is inside the panel where the member 37 is located.

A plunger 77 having a handle 78 can be moved inward to the position shown in FIG. 3 where it engages the upper outer end surface of a stop arm 80 that is bolted to the lifting wheel 44 at 81 as shown. In the outer position of the plunger 77, the lock arm 80 can pass between the adjacent ends of the bushings 82,83 which guide the plunger 77 so that the lifting wheel 44 is not blocked against further counterclockwise rotation. Where the plunger 77 is moved inward to block the stop arm 80, a static test can be made of the user's ability to exert maximum rearward pressure on the back pad 20 using his or her lumbar muscles. The output of the transducer 70 is directly related to such pressure, rather than to the pressure required to lift and support the counterweights 50. A static test can be made at various angles of the back, depending upon which one of the holes 60 in the lifting wheel 44 is being engaged by the pin 61.

As shown in FIG. 4, the back pad 20 is pivoted by brackets 90 and by pins or a shaft 91 for limited rotation about a horizontal axis. This axis essentially coincides with the radial center lines of the side members 21 and 21' of the frame 22 to allow torque to be applied at a constant moment arm length about the respective axes of the shafts 23 and 24 throughout a cycle of pivotal rotation.

OPERATION

In operation, the user or patient is seated on the pad 15 with the back of the pelvis against the bolsters 16, and with the legs bent somewhat. Both feet rest on the plate 18, which can be adjusted forward and rearward by a handwheel (not shown). The knee restraint pad 17 is lowered against the knees in such a manner that downward and inward force components are applied to the femurs. The thigh restraining devices 19 and 19' are adjusted by rotation of the handwheel shown in FIG. 1 to be against outer surfaces of the thighs, so that they are restrained against outward movement. The upper part of the back of the user engages the pad 20, and the constrainst mentioned above allow only the lumber muscles of the back to be used to pivot the frame member 22 backward and forward. The initial starting angle of the frame member 22 and the back pad 20 are adjusted to desired values by positioning the pin 61 in a selected one of the holes 60 in the lifting wheel 44.

To conduct a static test of the lumbar muscles at any one of the angles that is provided by adjustment of the pin 61, the plunger 77 is moved inward to block counterclockwise rotation of the stop arm 80, the lifting wheel 44 and the arm member 37. Torque forces applied by the user produce strains in the linkage 42 and in the block 71 that are measured by the gauges. This information is processed and stored in the computer. Hereagain the pin 61 can be positioned in different holes 60 for static tests at different back angles.

A cycle of exercise is initiated by the user after the plunger 77 has been moved to the outer position. As the user forces the frame 22 and pad 20 to pivot rearward, the pitman arm 32 rotates counterclockwise and causes corresponding rotation on the drive arm members 36,37 via the linkage 42 and the tension transducer 70. Rotation of the members 36,37 is transmitted to the lifting wheel 44 by the pin 61. As the wheel 44 rotates, the cable 45 is pulled downward, and the counterweight assembly 50 upward. Of course continuous pressure must be applied by the user to the pad 20 throughout a complete cycle of pivotal rotation in order to lift and support the weight 50.

The transducer 70 provides a continuous output that is directly related to the torque forces exerted by the user against the back pad 20, so that the work done in forcing the frame 22 rearward through a certain angle, and in allowing it to return to its starting position, is measured during each cycle. The output of the transducer 70 is fed to a computer which provides a display on a monitor of various types of information, such as torque vs. angle of rotation during each phase of each cycle until the user can no longer pivot the frame 22 rearward. Other information and displays that can be used or made will be apparent to those skilled in the art.

It now will be recognized that a new and improved exercise machine motion converting mechanism and force measurement means has been disclosed which meets all of the objectives of the present invention. Since certain changes or modifications may be made in the disclosed embodiment without departing from the inventive concepts involved, it is the aim of the following claims to cover all such changes and modifications that fall within the true spirit and scope of the present invention.

What is claimed is:

1. A mechanism for converting pivotal rotation of the back support frame of an exercise machine to linear vertical movement of a counterbalance weight assembly comprising: an enclosed compartment having inner and outer vertical walls; a pivotally arranged support frame; a stub shaft fixed to said support frame and extending at a right angle thereto through an opening in said inner wall; first arm means fixed to said stub shaft adjacent said inner wall and arranged for pivotal rotation with said stub shaft and said support frame; second arm means adjacent said first arm means and mounted on said stub shaft for pivotal rotation relative to said first arm means; means for linking said first arm means to said second arm means in a manner such that pivotal rotation of said first arm means causes pivotal rotation of said second arm means; lifting wheel means rotatably mounted on said stub shaft adjacent said second arm means and having an outer peripheral portion; selectively operable pin means extending through said outer wall for fastening said second arm means to said outer peripheral portion of said lifting wheel means in any one of a plurality of relative angular orientations with respect thereto; and a counterbalance weight assembly coupled to said lifting wheel means and adapted to resist rotation of said lifting wheel means, said second and first arm means and said support frame in one rotational direction.

2. The mechanism of claim 1 further including transducer means coupled in said linking means for providing output signals that are related to tension forces on said linkage means.

3. The mechanism of claim 2 further including an arcuate opening through said outer wall above said pin means, said opening being formed on a radius about the longitudinal axis of said stub shaft; and relative angle indicator means cooperable with said lifting wheel means, said second arm means and said arcuate opening for indicating the initial orientation of said second arm means relative to said lifting wheel means.

4. The mechanism of claim 3 wherein said indicator means includes a pointer having a lower portion fixed to an upper end of said second arm means, an intermediate portion extending through said arcuate opening to the outside of said outer wall, and an upper portion located on the outside of said outer wall adjacent said arcuate opening.

5. The mechanism of claim 1 further including stop means operable from the outside of said outer wall for preventing pivotal rotation of said lifting wheel means beyond a certain angular position.

6. A motion converting mechanism for an exercise machine comprising: an inverted, generally U-shaped frame member having opposite sides whose lower ends are pivotally mounted on a base by oppositely extending stub shafts which are attached to respective ones of said lower ends, said shafts being rotatable with said frame member; a pair of upright, spaced-apart walls on said base forming an inner wall and an outer wall; bearing means on said walls for mounting one of said stub shafts for pivotal rotation about a horizontal axis; first arm means located between said walls and fixed to said one stub shaft adjacent said inner wall so as to pivot with said one shaft, said first arm means having an outer end portion; second arm means mounted for relative rotation on said one shaft adjacent said first arm means and having upper and lower end portions located respectively above and below said axis; linkage means connecting said outer end portion of said first arm means to said lower end portion of said second arm means, whereby pivotal rotation of said frame member, said one stub shaft and said first arm means is transmitted to said second arm means; lifting wheel means adjacent said second arm means and mounted for relative rotation on said one shaft; and selectively operable latch means for releasably connecting said upper end portion of said second arm means to an outer peripheral portion of said lifting wheel means in any one of a plurality of angular positions relative thereto.

7. The mechanism of claim 6 wherein said second arm means includes inner and outer members mounted on the respective opposite sides of said lifting wheel means, said linkage means being connected to said inner member; and means for connecting the respective upper and lower portions of said inner and outer members to one another.

8. The mechanism of claim 6 wherein said latch means includes a pin member mounted on said upper portion of said outer member for movement between an outer position disengaged from said lifting wheel means and an inner position where said pin extends through an aperture in said lifting wheel means and into the upper portion of said inner member.

9. The mechanism of claim 6 further including tension force transducer means mounted in said linkage means for providing output signals that are related to the magnitude of tension forces in said linkage means as said first arm means tends to cause pivotal rotation of said second arm means.

10. The mechanism of claim 9 wherein said force transducer means includes a block having a pair of strain gauges mounted thereon, said block being shaped to provide an amplification of axial strain in said block.

11. The mechanism of claim 6 further including selectively operable means for locking said frame member against rearward pivotal rotation with respect to said base.

12. The mechanism of claim 11 wherein said locking means comprises a stop arm fixed to said lifting wheel means and extending outwardly of the outer periphery thereof; and a manually operated plunger extending through said outer wall and adapted to engage an upper surface of said stop arm to prevent further rotation of said lifting wheel means in one rotational direction.

13. The mechanism of claim 6 further including pointer means mounted on said upper portion of said second arm means so as to move therewith; an arcuate scale on said outer wall cooperable with said pointer means to provide a visual indication of the relative angular position of said second arm means and said lifting wheel means with respect to a reference.

14. The mechanism of claim 6 further including vertically movable countweight means; flexible means for connecting said counterweight means to the periphery of said lifting wheel means; and a set of at least three sheaves mounted near the upper ends of said walls for guiding said flexible means from said lifting wheel means to said counterweight means, one of said sheaves being rotatable in a horizontal plane.

15. The mechanism of claim 8 wherein the outer end portion of said pin member extends through an arcuate opening in said outer wall.

* * * * *